United States Patent [19]

Weekes et al.

[11] 4,431,191

[45] Feb. 14, 1984

[54] GAMING OR AMUSEMENT-WITH-PRIZES MACHINES

[76] Inventors: Charles W. Weekes, 17, Station Ter., Caerphilly, Mid. Glamorgan, Wales; Roy Pressland, 27, W. Yewstock Crescent, Chippenham, Wiltshire, England

[21] Appl. No.: 406,985

[22] Filed: Aug. 10, 1982

[30] Foreign Application Priority Data

Aug. 14, 1981 [GB] United Kingdom ..... 8124854

[51] Int. Cl.[3] ..... A63F 5/04

[52] U.S. Cl. ..... 273/143 R

[58] Field of Search ..... 273/143 R, 143 C, 143 D, 273/143 E, 138 R, 138 A

[56] References Cited

U.S. PATENT DOCUMENTS

| | | | |
|---|---|---|---|
| 2,812,182 | 11/1957 | Fiorino | 273/143 R |
| 3,684,290 | 8/1972 | Wayne | 273/143 C |
| 4,138,114 | 2/1979 | Andersen | 273/143 R |
| 4,373,727 | 2/1983 | Hooker et al. | 273/138 A X |

FOREIGN PATENT DOCUMENTS

| | | | |
|---|---|---|---|
| 2052824 | 1/1981 | United Kingdom | 273/143 R |
| 2061585 | 5/1981 | United Kingdom | 273/143 R |

*Primary Examiner*—Paul E. Shapiro

*Attorney, Agent, or Firm*—Young & Thompson

[57] ABSTRACT

A fruit machine has its reels operated by a spring-biased pull handle. This actuates a switch (31) at the limit of its pull against the spring, to energise stepper motors which drive the reels. To simulate the old-fashioned mechanical type, where tentative, incomplete pulls cause the reels to shift fractionally, the handle has associated sensors (35) which give pulse information on the extent and direction of handle movement. This is used to operate the stepper motors, which move the reels in sympathy through a small arc. A pawl (8) and ratchet (3) associated with the handle give further simulation of a purely mechanical reel triggering device.

6 Claims, 1 Drawing Figure

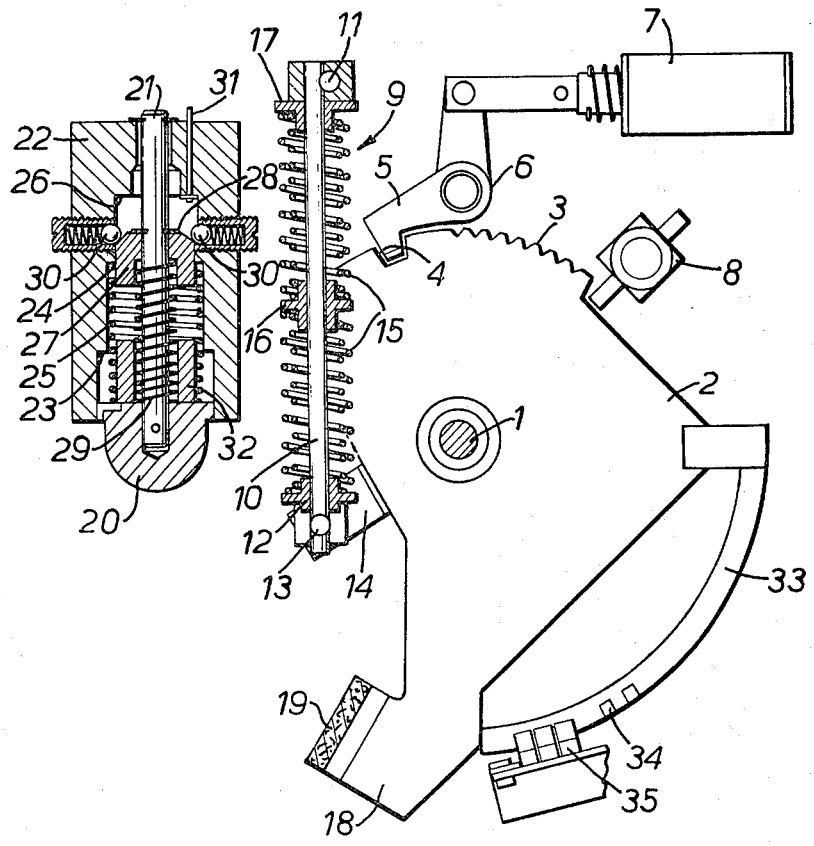
17
11
7
21
31
9
22
26
28
5
6
3
30
30
4
8
24
27
16
15
25
23
2
1
29
32
10
20
12
13
14
33
19
34
35
18

GAMING OR AMUSEMENT-WITH-PRIZES MACHINES

This invention relates to gaming or amusement-with-prizes machines. It is primarily concerned with those of the kind known as fruit machines in which a set of reels or drums are set spinning and eventually stop in a random fashion to show a combination of fruit or other symbols in display windows. Certain combinations in a line generate a prize.

In recent years in this country, such machines have nearly all been operated by press buttons or small levers on the front of the cabinet, and the drive mechanism has largely changed from motors with clutches and mechanical stop devices to electronically controlled stepper motors. However, in the USA, for example, the gambling public still expect the old-fashioned arm at the side of the machine which is pulled to set the reels in motion. It is also quite possible that nostalgia will dictate a return to such arms elsewhere.

The mechanical arrangements of an old arm-operated machine are extremely complicated. Now electronic control has been developed, it might seem logical simply to use the arm to operate a switch, which would then initiate the reel spin in the same way as pressing a button. However, one of the characteristics of the old machines is that, when the arm is partially pulled and released, the reels move slightly in sympathy. This is because the action of the arm starts to release stop pins from curved slots in the reels, and as these pins move radially, so the reels are forced by the shape of the slot to rotate slightly. Many players of such machines believe that by correct manipulation of the arm they can determine how the reels spin, and this is very much influenced by the fact that the reels can be seen to move slightly when the handle is worked before being pulled all the way to the final reel spinning position.

If the handle is simply used to operate a switch, this initial movement does not occur, and players tend to believe that they have no influence over the machine's performance.

According to the present invention there is provided a fruit machine of the kind described, wherein a pull handle is arranged to operate a switch at the limit of its pull to trigger rotation of the reels, and wherein sensor means are arranged to determine the nature and extent of any preliminary incomplete pulls on the handle and motor control means are arranged to respond to the sensors to cause reel stepper motors to shift the reels fractionally in sympathy.

Thus, there is simulation of reels operated entirely mechanically.

Preferably, there will be two fixed sensors close together and co-operating with a quadrant fixed to the handle shaft and having regular mark/space indicia around its arc. The sensors can be used to count the marks or spaces and so determine the extent of any pull, and also the speed and direction. The latter are more easily determined if the sensor spacing is slightly different from the indicia. This information can be translated by software into control for the stepper motors, which will move the reels accordingly.

The sensors could be used to trigger the eventual spin of the reels, for example when the mark count reaches a maximum. However, it is preferred to have a separate switch which is operated by the handle as it reaches the end of its pull, this releasing a spring biased actuator so that there is very positive operation of the switch.

For a better understanding of the invention, one constructional form will now be described, by way of example, with reference to the accompanying drawing, in which the single FIGURE is a side elevation, with some parts removed, of a trigger mechanism for a fruit machine.

A handle (not shown) is mounted on the outside of the fruit machine cabinet at about shoulder height, and is arranged to be pulled towards the operator to initiate a reel spin. It is fixed to a horizontal shaft 1, to which is secured in a radial plane inside the cabinet a plate 2 whose upper portion is formed with an arcuate toothed edge 3. Anti-clockwise from this as seen in the FIGURE is a recess 4 in which a pawl 5 at the end of a bell crank lever 6 can engage. The other arm of this lever is operated by a solenoid 7, which releases the pawl when a coin or token is inserted as a necessary preliminary to play. At the other end of the row of teeth 3, the plate steps radially inwards, and in the initial position as shown this step is adjacent a free running pawl 8. When the handle is pulled and the shaft 1 rotates, this pawl clicks over the teeth 3 and provides a mechanical check against the return of the handle until the latter has reached a forward limit. The pawl then capsizes and acts as a similar check during the reverse movement of the handle, preventing it being pulled forward again from an intermediate position. The pawl also produces an audible effect similar to that from old-fashioned machines.

A spring assembly 9 is arranged to provide resilient resistance to a pull on the handle and to return the latter to its initial position after release. A damper (not shown) may also be connected between the plate 2 or the shaft 1 and a fixed part of the machine to prevent too fast a return of the handle. In the spring assembly 9, a rod 10 is pivoted at 11 to the chassis of the machine and extends down in sliding fashion through a collar 12 pivoted at 13 to a bracket 14 on the plate 2. Coil springs 15 surround this rod 10, and act between the collar 12, an intermediate sliding collar 16 and a flange 17 at the upper end of the assembly. As the handle is pulled and the plate 2 rotates, these springs will be compressed, and the rod 10 will swing as necessary. The springs return the plate 2 and handle to the initial position when the handle is released.

Diametrically opposite the teeth 3, the plate 2 has a projection 18 with a buffer 19. At the end of the pull stroke, this is arranged to meet domed cap 20 at the lower end of a spring-loaded sliding pin 21. This assembly 20, 21 slides in a fixed body 22 with a central stepped bore providing a shoulder 23 which acts as a stop for the cap 20, a shoulder 24 against which a spring 25 acts, its other end bearing against the cap 20, and a shoulder 26 which provides a stop for a plunger 27 that is slidable on the pin 21 up to a limit formed by a circlip 28. A further spring 29 acts between the plunger and the cap 20, and the plunger is normally restrained to remain in its illustrated position by diametrically opposed spring loaded balls 30 which bear on a frusto-conical surface at its upper end. Projecting down from the shoulder 26 is the lower end of a switch actuating member 31, and a cylindrical spacer 32 rests on the cap 20 between the springs 25 and 29.

As the handle reaches the end of its pull the buffer 19 engages the cap 20 and forces it and the pin 21 to move upwardly. The springs 25 and 29 compress, but the plunger 27 is still retained in its lower position by the balls 30. However, as the cap 20 approaches the shoulder 23, so the spacer 32 engages the lower end of the plunger 27 and forces the latter upwards past the spring restraint of the balls 30. The action of the spring 29 is to "shoot" the plunger upwards to engage the actuator 31, and so close the switch which starts the reels spinning. At the same time, there is an audible effect as the plunger hits the shoulder 26. It is the combined effect of the spring loads 25 and 29, the sudden release of the plunger 27 and the audible impact of it against the shoulder 26 which simulates the action of releasing reels in a mechanical fruit machine. When the handle is released, the spring 25 returns the cap 20 to the lower position and the circlip 28 engages the plunger 27 to return that to its primed position.

In order to achieve the small initial movement of the reels, the plate 2 is fitted with an arcuate quadrant 33 centred on the shaft 1. This has regularly arranged mark/space indicia 34, which register with sensors 35 fixed to an adjacent part of the chassis. Their spacing does not quite match that of the indicia 34. As the handle is pulled, the quadrant 33 moves past the sensors which can count the marks, and therefore transmit information on the extent of the pull. With two sensors it is also possible to produce information on the speed and direction in which the handle is pulled, and this can be translated by software into pulse instructions for the stepper motors to shift their reels.

We claim:

1. A fruit machine of the kind described, wherein a pull handle is arranged to operate a switch at the limit of its pull to trigger rotation of the reels, and wherein sensor means are arranged to determine the nature and extent of any preliminary incomplete pulls on the handle, and motor control means are arranged to respond to the sensors to cause reel stepper motors to shift the reels fractionally in sympathy.

2. A fruit machine as claimed in claim 1, wherein a sensor co-operates with mark/space indicia in an arc concentric with the axis of rotation of the handle to provide pulses for the motor control means.

3. A fruit machine as claimed in claim 2, wherein there are two sensors with a spacing not integrally related to the pitch of the mark/space indicia.

4. A fruit machine as claimed in claim 3, wherein the switch is operated by a spring loaded actuator released by the handle at the limit of its pull.

5. A fruit machine as claimed in any one of the preceding claims, wherein a pawl co-operates with the handle over an initial arc of pull to prevent return movement of the handle while traversing that arc.

6. A fruit machine as claimed in claim 5, wherein the pawl allows the handle to return after movement through said arc and prevents further forward movement during such return.

* * * * *